United States Patent [19]

Morozumi

[11] Patent Number: 4,759,332

[45] Date of Patent: Jul. 26, 1988

[54] AIR-FUEL RATIO CONTROL SYSTEM FOR AUTOMOTIVE ENGINES

[75] Inventor: Takuro Morozumi, Mitaka, Japan

[73] Assignee: Fuji Jukogyo Kabushiki Kaisha, Tokyo, Japan

[21] Appl. No.: 937,967

[22] Filed: Dec. 4, 1986

[30] Foreign Application Priority Data

Dec. 11, 1985 [JP] Japan ..... 60-280111

[51] Int. Cl.[4] ..... F02D 33/00

[52] U.S. Cl. ..... 123/489; 123/440; 123/589

[58] Field of Search ..... 123/489, 480, 589

[56] References Cited

U.S. PATENT DOCUMENTS

| | | | |
|---|---|---|---|
| 4,485,786 | 12/1984 | Kashimura | 123/489 |
| 4,603,670 | 8/1986 | Bordech et al. | 123/489 |
| 4,612,889 | 9/1986 | Sugiura et al. | 123/489 |
| 4,625,699 | 12/1986 | Kobayashi et al. | 123/489 |

*Primary Examiner*—Raymond A. Nelli

*Attorney, Agent, or Firm*—Martin A. Farber

[57] ABSTRACT

An air-fuel ratio control system for an engine has a feedback control system operated in accordance with an output voltage of an $O_2$-sensor. When the output voltage becomes higher than a reference voltage, the operation of the feedback control system starts. The reference voltage is set to a high level when the engine is started, and set to a low level when a set time elapses after the starting of the engine.

4 Claims, 2 Drawing Sheets

AIR-FUEL RATIO CONTROL SYSTEM FOR AUTOMOTIVE ENGINES

BACKGROUND OF THE INVENTION

The present invention relates to a system for controlling air-fuel ratio of mixture for an automotive engine, and more particularly to a system for detecting an activated state of an $O_2$-sensor for restarting the engine.

The $O_2$-sensor does not produce a normal output voltage before the temperature of the sensor body rises above an activation temperature. Accordingly, an air-fuel ratio control operation using a feedback signal from the $O_2$-sensor must be started after the activation of the $O_2$-sensor.

The activation of the $O_2$-sensor can be determined by the fact that the output voltage of the $O_2$-sensor exceeds a predetermined reference value. For example, Japanese Patent Application Laid Open No. 58-8246 discloses a control system in which the sum of the output voltage of the $O_2$-sensor and a standard voltage is compared with a reference voltage.

However, there is a problem in the detection by the output voltage of the $O_2$-sensor. Namely, if the engine is re-started in the condition when the temperature of the $O_2$-sensor is in a low temperature range, the $O_2$-sensor produces a high error voltage for a period of time in spite of an inactivated state. In order to avoid such a malfunction, if the reference voltage is set to a high value, a long time elapses before staring the feedback operation in normal warming up of the engine.

SUMMARY OF THE INVENTION

Accordingly, the object of the present invention is to provide a control system which may prevent erroneous feedback control operation in an air-fuel ratio control system.

The air-fuel ratio control system for an automotive engine has an $O_2$-sensor producing an output voltage relative to oxygen concentration of exhaust gases of the engine, and a feedback control system responsive to the output voltage of the $O_2$-sensor for controlling the air-fuel ratio of the mixture supplied to the engine.

In accordance with the present invention, the system comprises detecting means for detecting starting of the engine and for producing an engine start signal, a timer responsive to the engine start signal for producing a first timer signal during a predetermined period of time and for producing a second timer signal after the predetermined period of time, $O_2$-sensor warm-up detecting means responsive to the first timer signal for comparing the output voltage of the $O_2$-sensor with a high level reference voltage and for producing a feedback control start signal when the output voltage of the $O_2$-sensor exceeds the high level reference voltage, and responsive to the second timer signal for comparing the output voltage of the $O_2$-sensor with a low level reference voltage which is lower than the high level reference voltage and for producing the feedback control start signal when the output voltage of the $O_2$-sensor exceeds the low level reference voltage. In response to the feedback control start signal, the operation of the feedback control system starts.

Since the reference voltage for detecting the activation of the $O_2$-sensor is set to a high value for the predetermined time after starting the engine, the detection of the activation can be done without malfunction, and the feedback control operation by the feedback signal of the $O_2$-sensor is started at a proper time. Further, since the reference voltage is changed to a low level when the predetermined time elapses, the feedback control operation starts at a proper time at cold engine operation without delay.

The other objects and features of this invention will become understood from the following description with reference to the accompanying drawings.

DETAILED DESCRIPTION OF THE PREFERRED EMBODIMENT

Figure 1:
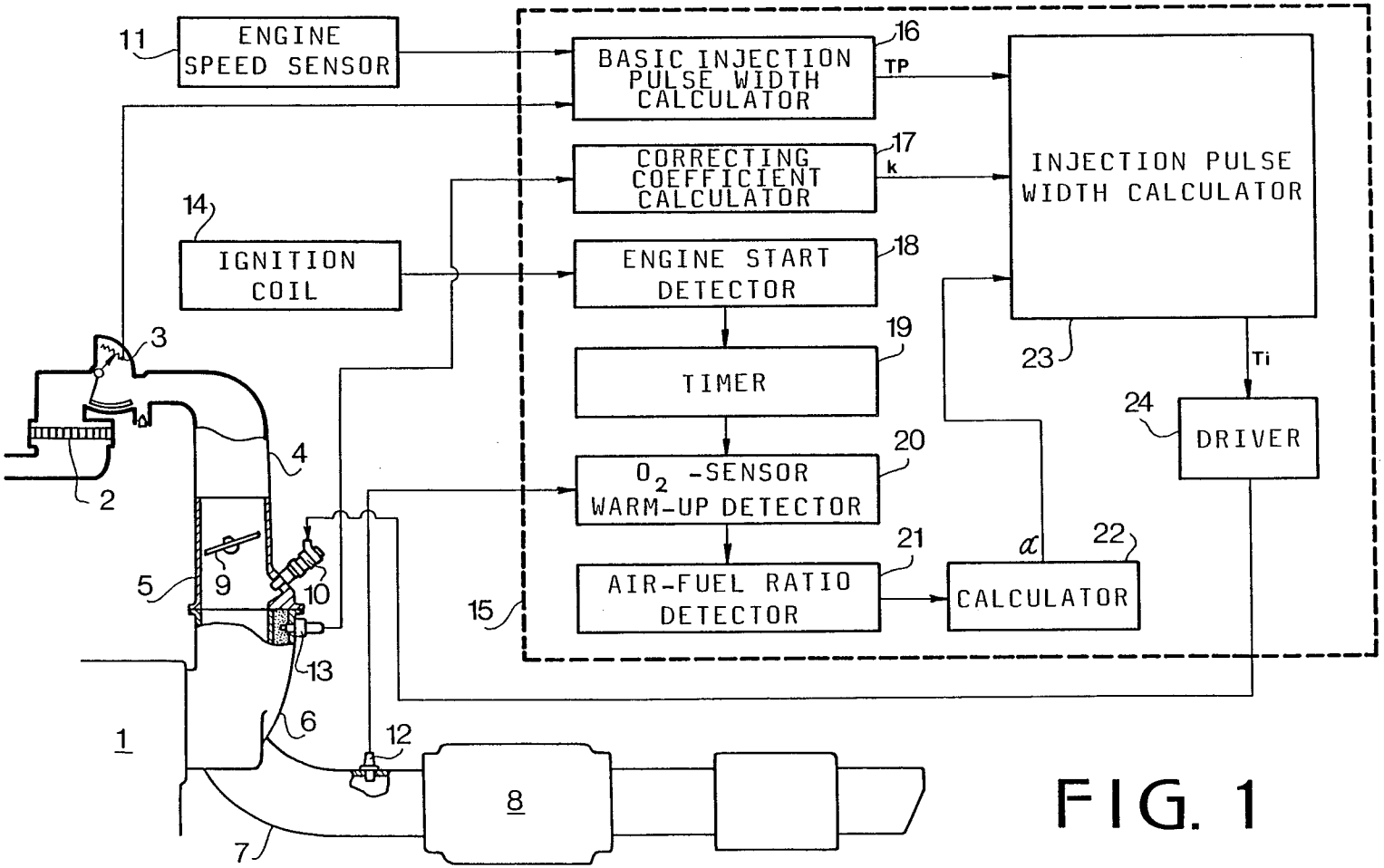
FIG. 1 is a schematic block diagram showing a system of the present invention.

Referring to FIG. 1, an automotive engine 1 has an intake pipe 4, a throttle body 5 and an intake manifold 6. Air is induced in the engine passing through an air cleaner 2, air flow meter 3 and throttle valve 9. An $O_2$-sensor 12 is provided on an exhaust pipe 7 at a position upstream of a catalytic converter 8. A fuel injector 10 is mounted on the throttle body 5 and a coolant temperature sensor 13 is mounted on a water jacket which is provided for pre-heating the intake air passing through the intake manifold 6. An engine speed sensor 11 is provided for producing an engine speed signal, and an ignition coil 14 is provided for producing an engine starting signal at the start of the engine.

Output signals of the air flow meter 3, sensors 11, 12, 13 and ignition coil 14 are applied to a control unit 15 which drives the injector 10 at an injection pulse width dependent on the signals, as described hereinafter in detail.

Output signals of the air flow meter 3 and engine speed sensor 11 are fed to a basic injection pulse width calculator 16 which produces a basic injection pulse width signal $T_P$. A correcting coefficient calculator 17 is applied with the output signal of the coolant temperature sensor 13 to generate a correcting coefficient signal K for the open loop control. The output signal of the $O_2$-sensor 12 passes through an $O_2$-sensor warm-up detector 20 and air-fuel ratio detector 21 to a correcting coefficient calculator 22 which produces a correcting coefficient signal $\alpha$ for the closed loop control.

The basic injection pulse width signal $T_P$ and correcting coefficient signals K and $\alpha$ are applied to an injection pulse width calculator 23 which produces an injection pulse width signal Ti. A driver 24 responds to the signal Ti and produces a driving output which is fed to the injector 10 to drive it.

On the other hand, the output signal of the ignition coil 14 is applied to an engine start detector 18 which produces an engine start signal when the engine is started. The engine start signal causes a timer 19 to operate to count down a stored number. The timer produces a timer signal for a set time (for example 10 sec.). In response to the timer signal, the warm-up detector 20 produces a high level reference voltage (for example 500 mV) for the set time after the engine start. The warm-up detector 20 compares the output voltage of the $O_2$-sensor with the high level reference voltage. When the output voltage exceeds the reference voltage, the warm-up detector produces a feedback control start signal which is fed to the air-fuel ratio detector 21, so that air-fuel ratio control operation by the feedback signal from the $O_2$-sensor starts. When the timer 19 counts the stored number (ten seconds), the timer signal disappears, so that the warm-up detector 20 produces a low level reference voltage (400 mV) to compare the output voltage of the $O_2$-sensor with the low level reference voltage.

Figure 2:
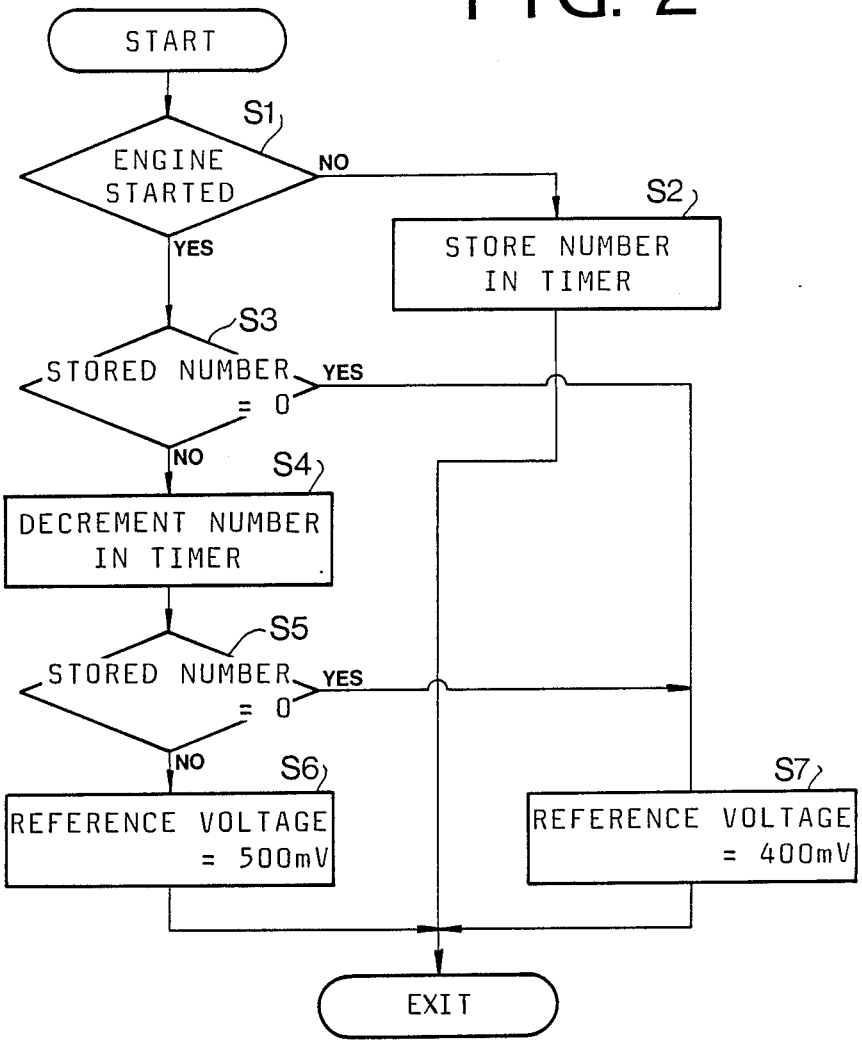
FIG. 2 is a flowchart showing the operation of the system.

The operation of the system is described hereinafter with reference to FIG. 2. At a step $S_1$, it is determined whether the engine is started. Since the engine does not start immediately after closing an ignition switch, the program proceeds to a step $S_2$ at the first cycle of the program. At the step $S_2$, a predetermined number corresponding to the set time (10 sec.) is stored in the timer 19. In the next program, if the engine is started, the program proceeds to a step $S_3$ where it is determined whether the timer 19 is cleared (stored number is zero). When the timer has a stored number, the number is continuously decremented by one at a step $S_4$. At a step $S_5$, if the stored number is not yet zero, the program goes to a step $S_6$, where the reference voltage is set to the high level (500 mV). If the timer is cleared at step $S_3$ or $S_5$, the program proceeds to a step $S_7$, where the low level reference voltage (400 mV) is set.

Thus, in the system of the present invention, the reference voltage for detecting the activation of the $O_2$-sensor is set to a high value for a set time after starting the engine. Accordingly, the detection of the activation can be done without malfunction, and the feedback control operation by the feedback signal of the $O_2$-sensor is started at a proper time. Further, since the reference voltage is changed to a low level when a set time elapses after starting the engine, the feedback control operation starts at a proper time at cold engine operation without delay.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. In an air-fuel ratio control system for an automotive engine, the system having an $O_2$-sensor producing output voltage relative to oxygen concentration of exhaust gases of the engine, a feedback control system responsive to the output voltage of the $O_2$-sensor for controlling air-fuel ratio of mixture supplied to the engine, the improvement comprising:

detecting means for detecting starting of the engine and for producing an engine start signal;

a timer responsive to the engine start signal for producing a first timer signal during a predetermined period of time and for producing a second timer signal after the predetermined period of time;

$O_2$-sensor warm-up detecting means responsive to the first timer signal for comparing the output voltage of the $O_2$-sensor with a high level reference voltage and for producing a feedback control start signal when the output voltage of the $O_2$-sensor exceeds the high level reference voltage, and responsive to the second timer signal for comparing the output voltage of the $O_2$-sensor with a low level reference voltage which is lower than the high level reference voltage and for producing the feedback control start signal when the output voltage of the $O_2$-sensor becomes higher than the low level reference voltage;

means responsive to the feedback control start signal for starting operation of the feedback control system.

2. The system according to claim 1 wherein the first-mentioned detecting means is responsive to a signal from an ignition coil of the engine for producing the engine start signal.

3. The system according to claim 1 wherein the timer is a counter in which a desired number can be stored.

4. The system according to claim 1, further comprising means for storing a number representing the predetermined time when the first-mentioned detecting means does not produce the engine start signal, and said timer for decrementing the stored number to zero thereafter when the first-mentioned detecting means produces the engine start signal, whereupon said $O_2$-sensor warm-up detecting means provides the low level reference voltage, and wherein, during said decrementing before zero is reached said $O_2$-sensor warm-up detecting means produces the high level reference voltage.

* * * * *